US009970641B2

(12) United States Patent
Mousavi

(10) Patent No.: US 9,970,641 B2
(45) Date of Patent: May 15, 2018

(54) ELECTRICAL OUTLET WITH COVERING AND LIGHT AND METHOD OF USE FOR THE SAME

(71) Applicant: Kevin Mousavi, Katy, TX (US)

(72) Inventor: Kevin Mousavi, Katy, TX (US)

( * ) Notice: Subject to any disclaimer, the term of this patent is extended or adjusted under 35 U.S.C. 154(b) by 0 days. days.

(21) Appl. No.: 15/176,749

(22) Filed: Jun. 8, 2016

(65) Prior Publication Data

US 2017/0356638 A1 Dec. 14, 2017

(51) Int. Cl.

| | |
|---|---|
| ***F21V 33/00*** | (2006.01) |
| ***F21V 23/06*** | (2006.01) |
| ***H01R 25/00*** | (2006.01) |
| ***H01R 13/447*** | (2006.01) |
| ***F21V 23/04*** | (2006.01) |
| ***F21S 9/02*** | (2006.01) |
| ***F21V 3/00*** | (2015.01) |
| ***F21V 17/10*** | (2006.01) |
| *F21Y 101/02* | (2006.01) |

(52) U.S. Cl.

CPC ..... *F21V 23/06* (2013.01); *F21S 9/02* (2013.01); *F21V 3/00* (2013.01); *F21V 17/107* (2013.01); *F21V 23/04* (2013.01); *F21V 23/0464* (2013.01); *H01R 13/447* (2013.01); *H01R 25/006* (2013.01); *F21Y 2101/02* (2013.01)

(58) Field of Classification Search

CPC ..... F21S 9/024; F21S 9/02; F21V 23/0464; F21V 3/00; F21V 17/108; F21V 23/04; F21V 23/06; H01R 13/447; H01R 13/453; H01R 13/4532; H01R 13/4534; H01R 13/4536; H01R 13/4538; H01R 25/006

USPC ..... 362/20, 95, 641–647, 652–653

See application file for complete search history.

(56) References Cited

U.S. PATENT DOCUMENTS

| | | | | |
|---|---|---|---|---|
| 2,227,549 | A * | 1/1941 | McNeill | H01R 13/631 200/310 |
| 4,000,405 | A | 12/1976 | Horwinski | |
| 4,672,229 | A | 6/1987 | Skarman et al. | |
| D330,267 | S | 10/1992 | Hendrix | |
| 5,240,426 | A | 8/1993 | Barla | |
| 5,264,662 | A * | 11/1993 | Kennedy | H01R 13/447 174/67 |
| 5,481,442 | A | 1/1996 | Dickie et al. | |
| 5,652,568 | A | 7/1997 | Ko | |

(Continued)

*Primary Examiner* — Jason Moon Han

(74) *Attorney, Agent, or Firm* — Ewing & Jones PLLC; Ira Domnitz

(57) ABSTRACT

An outlet and nightlight device with a solid base. The base has a front, back, top and two outlets on the front the base. There are two plugs on the back of the base, a light sensor, and a light emitter. The front of the base is attached to a raised section which is attached and in moveable communication with a face plate. In some embodiments the face plate slides across the raised section and in others it can rotate away from the raised section via a hinge on the base plate. The light sensor can trigger to the light emitter to emit light in low light conditions and in some embodiments there is a manual trigger for the light emission. In some embodiments the base has USB port for utilization. In some embodiments the face plate can lock to the base plate. In some embodiments the present invention has ancillary light emitters on the raised plate. In some embodiments of the invention there is a battery back up to supply energy to the light emitter in case of power failure.

2 Claims, 7 Drawing Sheets

(56) References Cited

U.S. PATENT DOCUMENTS 5,660,459 A 8/1997 Appelberg
5,675,125 A * 10/1997 Hollinger ..... H02B 1/26 174/66
5,813,873 A * 9/1998 McBain ..... H01R 13/443 439/145
5,816,682 A 10/1998 Marischen
6,051,787 A 4/2000 Rintz
6,087,588 A 7/2000 Soules
D429,829 S 8/2000 Doran
6,342,676 B1 1/2002 Ha
6,423,900 B1 7/2002 Soules
6,478,440 B1 11/2002 Jaworski et al.
6,649,838 B1 11/2003 Lopez, Sr. et al.
6,794,575 B1 9/2004 McBain et al.
6,916,989 B2 7/2005 Broussard, Jr.
7,011,422 B2 3/2006 Robertson et al.
7,025,473 B2 4/2006 Dokoupil
7,045,975 B2 * 5/2006 Evans ..... F21S 8/035 315/149
7,094,969 B1 * 8/2006 In ..... H02G 3/14 174/66
7,229,322 B2 6/2007 Bangert
7,726,825 B2 6/2010 Mandapat et al.
7,915,528 B2 3/2011 Ni
8,304,652 B2 11/2012 McBain
8,399,765 B1 3/2013 Baldwin et al.
8,704,091 B1 4/2014 Shotey et al.
9,312,704 B2 * 4/2016 Tinaphong ..... H02J 7/0004
2003/0092297 A1 * 5/2003 Reindle ..... H01R 31/02 439/107
2005/0109529 A1 * 5/2005 Nagashima ..... H02G 3/14 174/67
2008/0233780 A1 9/2008 Waters et al.
2009/0188693 A1 7/2009 Simmons
2013/0175992 A1 * 7/2013 Tinaphong ..... H02J 7/0004 320/111
2015/0338039 A1 * 11/2015 Magee ..... F21S 8/035 362/20

* cited by examiner

ELECTRICAL OUTLET WITH COVERING AND LIGHT AND METHOD OF USE FOR THE SAME

CROSS-REFERENCE TO RELATED APPLICATIONS

Not applicable.

STATEMENT REGARDING FEDERALLY SPONSORED RESEARCH

Not applicable

BACKGROUND

The present invention, and inventive system, is a new and novel invention that works as an improved electrical outlet with cover and light. One goal of the present invention is to provide a lighting function on an outlet cover with a cover and additional outlet sockets for users to utilize therein not clogging or congesting a standard wall out let. In some embodiments of the present invention the outlet with cover and light maybe locked to prevent children from accessing the socket. In several embodiments the present invention has a battery for emergency back up.

The present invention is readily distinguishable from the following prior art:

U.S. Pat. No. 4,000,405 to Horwinski discloses a night light that is controlled by a mechanical switch on the actual side of the device. The present invention is distinguished from U.S. Pat. No. 4,000,405 because the present invention offers a light sensor control and does not require a manual manipulation in order to activate the nightlight. It has USB ports that add to the existing number of outlets and it has a battery that provides walkway lighting when the outlet loses power. It has a 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It also solves the problem of providing childproofing of an outlet without losing the functionality of said outlet and never has to be removed like other outlet childproofing devices. It solves the problem of providing light in situations when there is no power and no light in emergency situations.

U.S. Pat. No. 5,240,426 to Barla fails to include the nightlight feature of some embodiments of the present invention. The present invention is distinguished from U.S. Pat. No. 5,240,426 because the present invention offers a night light with a sensor to control operation. It has an override switch to bypass the light sensor to keep the light on all the time. It has USB ports that add to the existing number of outlets and it has a battery that provides walkway lighting when the outlet loses power. It has a beveled face to allow the cover to close and secure/cover plugs that have been plugged into the outlet it has a sliding hinge pin that allows it to flip open and closed, it has 3 push click tabs that act as a child lock securing live outlets and can also lock at multiple levels. In several embodiments the present invention solves the problem of providing light in the area so that the outlets can be easily accessed. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,652,568 to Ko does not disclose a night light that is controlled with a sensor. The present invention is distinguished from U.S. Pat. No. 5,652,568 because the present invention offers a nightlight with a sensor to control operation. It has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,816,682 to Marischen discloses a night light that is not controlled by a sensor, unlike the present invention that offers a light sensor to control operation and has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,813,873 to McBain does not have a night light much less one controlled with a sensor. The present invention is distinguished from U.S. Pat. No. 5,813,873 because the present invention offers a night light with a sensor to control operation. The present invention has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,660,459 to Appleberg does not have a night light nor a night light controlled with a sensor. The present invention is distinguished from U.S. Pat. No. 5,660,459 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to utilize both outlets while providing a sliding decorative cover and also provides light in the area so that the outlets can be easily accessed. It solves the problem of providing light in situations when there is no power and no light in emergency situations.

U.S. Pat. No. 6,051,787 to Rintz does not have a night light controlled with a sensor. The present invention is distinguished from U.S. Pat. No. 6,051,787 because the present invention offers a light sensor to control operation. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices.

U.S. Pat. No. 7,915,528 to Ni does not have a night light. The present invention is distinguished from U.S. Pat. No. 7,915,528 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 6,478,440 Jaworski does not have a night light that connects into both outlets on a wall therefore covering the entire faceplate of the wall outlet nor does it disclosure a protective cover. The present invention is distinguished from U.S. Pat. No. 6,478,440 because the present invention offers an override switch to bypass the light sensor to keep the light on all the time. It has USB ports that add to the existing number of outlets and it has a battery that provides walkway lighting when the outlet loses power. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It has 3 push click tabs that act as a child lock securing live outlets and can also lock at multiple levels. It solves the problem of providing a light while still having the ability to still utilize both outlets while providing a sliding decorative cover and also provides light in the area so that the outlets can be easily accessed. It solves the problem of providing light in situations when there is no power and no light in emergency situations in many embodiments.

US Patent Application 2009/0188693 to Simmons does not disclose a night light. The present invention is distinguished from 2009/0188693 because the present invention includes a night light and offers an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed; it solves the problem of providing a light while still having the ability to still utilize both outlets while providing a sliding decorative cover and also provides light in the area so that the outlets can be easily accessed. It solves the problem of providing light in situations when there is no power and no light in emergency situations.

US Patent Application 2003/0092297 to Reindle et al discloses a night light that is not controlled by a sensor. The present invention is distinguished from 2003/0092297 because the present invention offers a light sensor to control operations. The present invention offers USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet. It has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed.

US Patent Application 2008/0233780 to Waters has neither a night light nor a night light that is controlled with a sensor. The present invention is distinguished from 2008/0233780 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet. It has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover. It solves the problem of providing light in situations when there is no power and no light in emergency situations.

U.S. Pat. No. 6,916,989 to Brousard Jr. does not have a night light. The present invention is distinguished from U.S. Pat. No. 6,916,989 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. In several embodiments the present invention solves the problem of providing light in the area so that the outlets can be easily accessed. It also solves the problem of providing a light while still having the ability to still utilize both outlets while providing a sliding decorative cover. It solves the problem of providing light in situations when there is no power and no light in emergency situations.

U.S. Pat. No. 8,399,765 to Baldwin et al does not have a night light. The present invention is distinguished from U.S. Pat. No. 8,399,765 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 7,094,969 to In does not have a night light. The present invention is distinguished from U.S. Pat. No. 7,094,969 because the present invention offers a night light with a sensor to control operation. The present invention also has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,264,662 to Kennedy does not have a night light. The present invention is distinguished from U.S. Pat. No. 5,264,662 because the present invention offers a night light that a sensor and has an override switch to bypass the light sensor to keep the light on all the time. It has USB ports that add to the existing number of outlets and it has a battery that provides walkway lighting when the outlet loses power. It has 3 push click tabs that act as a child lock securing live outlets and can also lock at multiple levels. It has a beveled face to allow the cover to close and secure. It has a sliding hinge pin that allows it to flip open and closed. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 6,087,588 to Soules does not have a night light. The present invention is distinguished from U.S. Pat. No. 6,087,588 because the present invention offers a night light with a sensor to control. The present invention also has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 6,649,838 to Lopez, Jr. et al does a night light. The present invention is distinguished from U.S. Pat. No. 6,649,838 because the present invention offers a night light with a sensor to control. The present invention also has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 8,304,652 to McBain does not have a night light. The present invention is distinguished from U.S. Pat. No. 8,304,652 because the present invention has a night light with a sensor to control operation. The present invention in several embodiments has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 6,794,575 to McBain et al does not have a night light. The present invention is distinguished from U.S. Pat. No. 6,794,575 because the present invention has a night light that sensor to control operation . . . . And has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 7,025,473 to Dokoupil discloses a night light that is controlled by a sensor. The present invention has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet; it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations U.S. Pat. No. 8,704,091 to Shotey et al does not have a night light that is controlled by a sensor. The present invention is distinguished from U.S. Pat. No. 8,704,091 because the present invention offers a night light with a sensor to control. The present invention also has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet; it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. D330,267 to Hendrix does not have a night light that offers a sensor to control operation. In several embodiments this invention is different from D330,267 because the present invention offers a night light with both a sensor to control operation and an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover. It solves the problem of providing light in situations when there is no power and no light in emergency situations.

U.S. Pat. No. D 429,829 to Doran does not have a night light that has a sensor to control operation. In several embodiments this invention is different from D429,829 because the present invention offers a night light that has both and sensor to control operations and an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover. It solves the problem of providing light in situations when there is no power and no light in emergency situations.

U.S. Pat. No. 7,726,825 to Mandapat discloses a night light that is not controlled by a sensor. In several embodiments this invention is different from U.S. Pat. No. 7,726,825 because the present invention offers a sensor to control operation and has an override switch to bypass the sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet; it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover. It solves the problem of providing light in situations when there is no power and no light in emergency situations.

U.S. Pat. No. 6,342,676 to Ha does not have a night light nor does it have one that is controlled with a sensor. In several embodiments this invention is different from U.S. Pat. No. 6,342,676 because the present invention has a night light with a sensor to control operation. And has an override switch to bypass the light sensor to keep the light on all the time. It has USB ports that add to the existing number of outlets and it has a battery that provides walkway lighting when the outlet loses power. It has a beveled face to allow the cover to close and secure/cover plugs that have been plugged into the outlet it has a sliding hinge pin that allows it to flip open and closed it has push click tabs that act as a child lock securing live outlets and can also lock at multiple levels. In several embodiments the present invention solves the problem of providing light in the area so that the outlets can be easily accessed. It also solves the problem of providing a light while still having the ability to still utilize both outlets while providing a sliding decorative cover. Solves the problem of providing light in situations when there is no power and no light in emergency situations.

U.S. Pat. No. 6,423,900 to Soules does not have a night light controlled with a sensor. In several embodiments this invention is different from U.S. Pat. No. 6,423,900 because the present invention has a night light with a sensor to control operation and has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 6,478,440 to Jaworski does not have a night light that provides light without losing the use of both outlets. In several embodiments this invention is different from U.S. Pat. No. 6,478,440 because the present invention offers an override switch to bypass the light sensor to keep the light on all the time. It has USB ports that add to the existing number of outlets and it has a battery that provides walkway lighting when the outlet loses power. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It has push click tabs that act as a child lock securing live outlets and can also lock at multiple levels. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 7,229,322 to Bangert does not have a night light nor does it have one that is controlled with a sensor. In several embodiments this invention is different from U.S. Pat. No. 7,229,322 because the present invention offers a night light with a sensor to control operation and has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 5,481,442 to Dickie does not have a night light that offers a sensor to control operation. In several embodiments this invention is different from U.S. Pat. No. 5,481,442 because the present invention offers a night light with a sensor to control operation and an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It solves the problem of providing light in situations when there is no power and no light in emergency situations.

U.S. Pat. No. 7,011,422 to Robertson does not have a night light. In several embodiments this invention is different from U.S. Pat. No. 7,011,422 because the present invention offers a night light with a sensor to control operation and an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed it solves the problem of providing childproofing of an outlet without losing the functionality of said outlet and never has to be removed like other outlet childproofing devices. It solves the problem of providing a light while still having the ability to still utilize both outlets while providing a sliding decorative cover. It solves the problem of providing light in situations when there is no power and no light in emergency situations.

U.S. Pat. No. 4,672,229 to Skarman discloses a night light that is not controlled by a sensor. In several embodiments this invention is different from U.S. Pat. No. 4,672,229 because the present invention offers a sensor to control operation and has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet it has a sliding hinge pin that allows it to flip open and closed. It solves the problem of providing a light while still having the ability to still utilize both outlets while providing a sliding decorative cover. It solves the problem of providing light in situations when there is no power and no light in emergency situations.

US Patent 2005-070952 to Nagashima discloses a night light that is not controlled by a sensor. In several embodiments this invention is different from US 2005-070952 because the present invention offers a sensor to control operation and has an override switch to bypass the light sensor to keep the light on all the time. It has USB ports that add to the existing number of outlets and it has a battery that provides walkway lighting when the outlet loses power. It has push click tabs that act as a child lock securing live outlets and can also lock at multiple levels. It has a beveled face to allow the cover to close and secure/cover plugs that have been plugged into the outlet. It solves the problem of providing childproofing of an outlet without losing the functionality of said outlet and never has to be removed like other outlet childproofing devices. It solves the problem of providing a light while still having the ability to still utilize both outlets while providing a sliding decorative cover and also provides light in the area so that the outlets can be easily accessed. It also solves the problem of providing childproofing of an outlet without losing the functionality of said outlet and never has to be removed like other outlet childproofing devices. It solves the problem of providing light in situations when there is no power and no light in emergency situations.

SUMMARY

In several embodiments of the present invention, the present invention operates under several parameters.

Standard night lights occupy at least one outlet on standard two port wall outlet. This makes it difficult to use multiple devices on a single wall outlet. The present device alleviates this problem by offering a nightlight that allows for the two ports of a standard wall outlet to be used while also providing a light emitter or night light.

In several embodiments of the present invention, the present invention can provide a sliding cover which can cover the standard two port wall outlet when the ports are not in use. In some embodiments of the present invention the cover can rotate about a hinge attached to the base of the invention. In some embodiments this cover can be locked or fashioned in a manner to maintain it in a closed position over the second wall outlets. In several embodiments the present invention can utilize a face plate with a bubble that extends outward allowing for extra space for and cords attached to the interior plug. In several embodiments of the present invention the bubble face plate has an egress port allowing for the face plate to be close (and potentially) locked while having cords still attached in the plug. In several embodiments of the present invention there is a backup battery attached behind the base plate to allow for power to be distributed to the light emitter in case of a power outage or stoppage.

In some current night light devices available on the market, the night light can plug into an outlet and provide a decorative look to a receptacle and also have a sensor for lights at night. The problem is that while providing aesthetics and a night light function, it completely eliminates the use of the outlet. Anytime the outlet needs to be used the unit must be removed to utilize the outlet which completely eliminates its practicality.

The present invention, in several embodiments, will not only provide an aesthetic appearance, provide a light at night with a sensor, but will also retain the functionality of the outlet. In several embodiments the present invention, it has the ability to attach to any standard plug to secure the unit to the outlet. In several embodiments, the present invention will have the ability to slide up down or open outward in a rotation in order to access the outlet under the decorative cover.

In several embodiments the present invention has the ability to expand and slide a cover plate in order to cover the plug head that is utilizing the outlet. In several embodiments the present invention can be a part that can connect to an existing outlet cover, but can also come as one piece that has an outlet cover attached to it in mechanical communication. In several embodiments the present invention utilizes both plug sockets of a wall outlet, eliminating the need to ever remove the unit. In several embodiments the present invention has the ability to lock which can also be utilized for child proofing. In several embodiments, the present invention has the option available for child proofing are ones that plug into an outlet and eliminate the use unless removed. In several embodiments of the present invention there is an option for USB ports.

In some embodiments the present inventive device is an outlet and nightlight device comprising; a solid base with a front, back, top and bottom; said solid base further comprising; two outlets on the front of said solid base; two plugs on the back of said solid base; a light sensor, a light emitter; a raised plate on the front of said base; a face plate; said face plate further comprising side overhangs; wherein said face plate can move distal to said base plate. In some embodiments of the present invention the present invention further comprises a hinge; said face plated is attached and in mechanical communication with said base plate through said hinge. In some embodiments of the present invention the present invention further comprises; said raised plate further comprises tracks on the side of said raised plate; said face plated is attached and in mechanical communication with said base plate through said overhangs placed in mechanical communication with said tracks. In some embodiments of the present invention the present invention further comprises; said base plate further comprises ports for USB cable insertion. In some embodiments of the present invention the present invention further comprises; said raised plate further comprises a manual activation button for manually activating said light emitter. In some embodiments of the present invention the present invention further comprises; said face plate is partially transparent. In some embodiments of the present invention said base plate can mechanically lock with said face plate in a closed position.

In some embodiments of the present invention the present invention comprises: a method for utilizing an outlet and nightlight device comprising the steps of; obtaining a solid base with a front, back, top and bottom; said solid base further comprising; two outlets on the front of said solid base; two plugs on the back of said solid base; a light sensor; a light emitter, a raised plate on the front of said base; obtaining a face plate; said face plate further comprising side overhangs; activating the light emitter via a signal from said sensor in low light conditions. In some embodiments of the present invention the present invention further comprises the steps of; obtaining a hinge; attaching said face plate with said base plate through said hinge; and rotating said face plate about said hinge to modify access to said outlets. In some embodiments of the present invention the present invention further comprises the steps of; constructing said face plate with tracks on the side of said raised plate; attaching said face plate in mechanical communication with said base plate through said overhangs placed in mechanical communication with said tracks; and sliding said face plate about said tracks to modify access to said outlets. In some embodiments of the present invention the present invention further comprises the steps of providing base plate with ports for USB cable insertion. In some embodiments of the present invention the present invention further comprises the steps of providing said base plate with a manual activation button for manually activating said light emitter. In some embodiments of the present invention the present invention further comprises the steps of; providing a face plate that is partially transparent. In some embodiments of the present invention the present invention further comprises mechanically locking said face plate with said base plate in a closed position.

In some embodiments the present inventive device is an outlet and nightlight device comprising; a solid base with a front, back, top and bottom; said solid base further comprising; two outlets on the front of said solid base; two plugs on the back of said solid base; a light sensor, a light emitter; a base orifice for a pin; a raised plate on the front of said base; a face plate; a face orifice for a pin; said face plate further comprising side overhangs; a pin; said face plate further comprising side overhangs; wherein said face plate can move distal to said base plate and said pin can mechanically engage said face plate and said base plate to a wall outlet via insertion and mechanical attachment though said face orifice and said base orifice. In some embodiments of the present invention the present invention further comprises a hinge; said face plated is attached and in mechanical communication with said base plate through said hinge. In some embodiments of the present invention the present invention further comprises; said raised plate further comprises tracks on the side of said raised plate; said face plated is attached and in mechanical communication with said base plate through said overhangs placed in mechanical communication with said tracks. In some embodiments of the present invention the present invention further comprises; said base plate further comprises ports for USB cable insertion. In some embodiments of the present invention the present invention further comprises; said raised plate further comprises a manual activation button for manually activating said light emitter. In some embodiments of the present invention the present invention further comprises; said face plate is partially transparent. In some embodiments of the present invention said base plate can mechanically lock with said face plate in a closed position.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
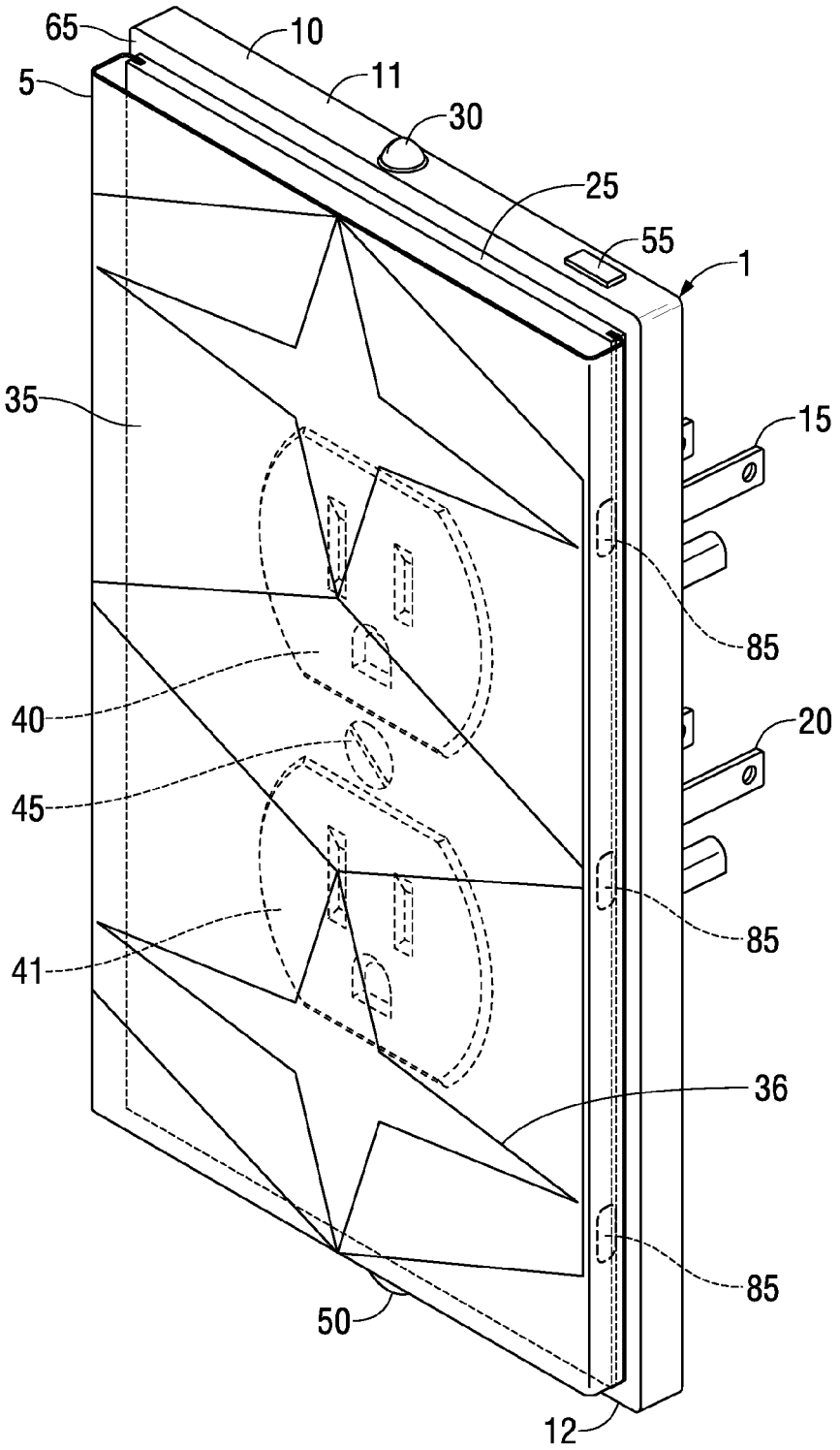
FIG. 1 illustrates one embodiment of the present invention in assembled view from the front.

In the following description, certain details are set forth such as specific quantities, sizes, etc. . . . so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

One, or more, illustrative embodiments incorporating the invention disclosed herein are presented below. Applicants have created a revolutionary and novel system and method for use of an improved electrical outlet cover and light.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. "Light Emitter" or "Night Light" as defined herein includes, but is not limited to, any light creating device or bulb. "Face plate" as defined herein includes, but is not limited to, a clear, semi-transparent, solid, or solid with egress ports for cords, designed to substantially cover a face plate and can be permanent or removable. "Battery" as defined herein includes, but is not limited to, any electronic energy storage device. "Tracks" as defined herein includes, but is not limited to, a track, indention or molded pathway. "Hinge" as defined herein includes, but is not limited to, any type of mechanism used to join two bodies but all for movement of said bodies in relation to each other. "Outlet" as defined herein includes, but is not limited to a standard socket outlet, a light fixture setting, or any facing used for providing and electrical current. Definitions and/or interpretations should not be incorporated from other patent applications, patents, or publications, related or not, unless specifically stated in this specification or if the incorporation is necessary for maintaining validity.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 illustrates one embodiment of the present invention in assembled view from the front. As illustrated the improved light emitter with outlets 1 is preferably constructed with a solid base 10. Solid base 10 is preferably constructed with a front 65 and back 60 (see FIGS. 2 and 3). In many embodiments solid base 10 is constructed of plastic, resin or some other preferably non-conductive materials. Solid base 10 can be constructed to various widths, sizes, or shapes as is known in the art. In many embodiments of the present invention, solid base 10 has a hollow interior which can house electronic circuitry as is known in the art for wall sockets.

As illustrated in FIG. 1, solid base 10 can be constructed with a top 11 and a bottom 12. In several embodiments of the present invention the solid base 10 may be constructed with a light sensor or light emitter sensor 30 located on the top 11 of the base 10. In several embodiments of the present invention the light sensor 30 can be located on other areas of the body 10 or on the light emitter with outlets 1 itself. In several embodiments of the present invention the light sensor 30 is one commonly used in the art for detecting light levels and activating a bulb or LED to illuminate.

As illustrated in FIG. 1, in several embodiments of the present invention the solid base 10 may be constructed with a light emitter 50 located on the top bottom 12 of the base 10. In several embodiments of the present invention the light emitter 50 can be located on other areas of the body 10 or on the light emitter with outlets 1 itself. In several embodiments of the present invention the light sensor 30 is one commonly used for illumination of walk ways or areas with minimal lighting for mostly dark conditions. In several embodiments of the present invention the light emitter 50 and the light sensor 30 are in electrical communication in a manner as known in the art for low light level triggering of the light emitter into an illuminated state.

As illustrated in FIG. 1, in several embodiments of the present invention the solid base 10 may be constructed with a manual activation button 55 for the light emitter 50 located on the top bottom 12 of the base 10. In several embodiments of the present invention the manual activation button 55 can be located on other areas of the body 10 or on the light emitter with outlets 1 itself. In several embodiments of the present invention the manual activation button is one commonly used for manually activating a light emitter as used in the industry. In several embodiments of the present invention the light emitter 50 and the manual activation button 55 are in electrical communication in a manner as known in the art for manually triggering the light emitter into an illuminated state.

Figure 2:
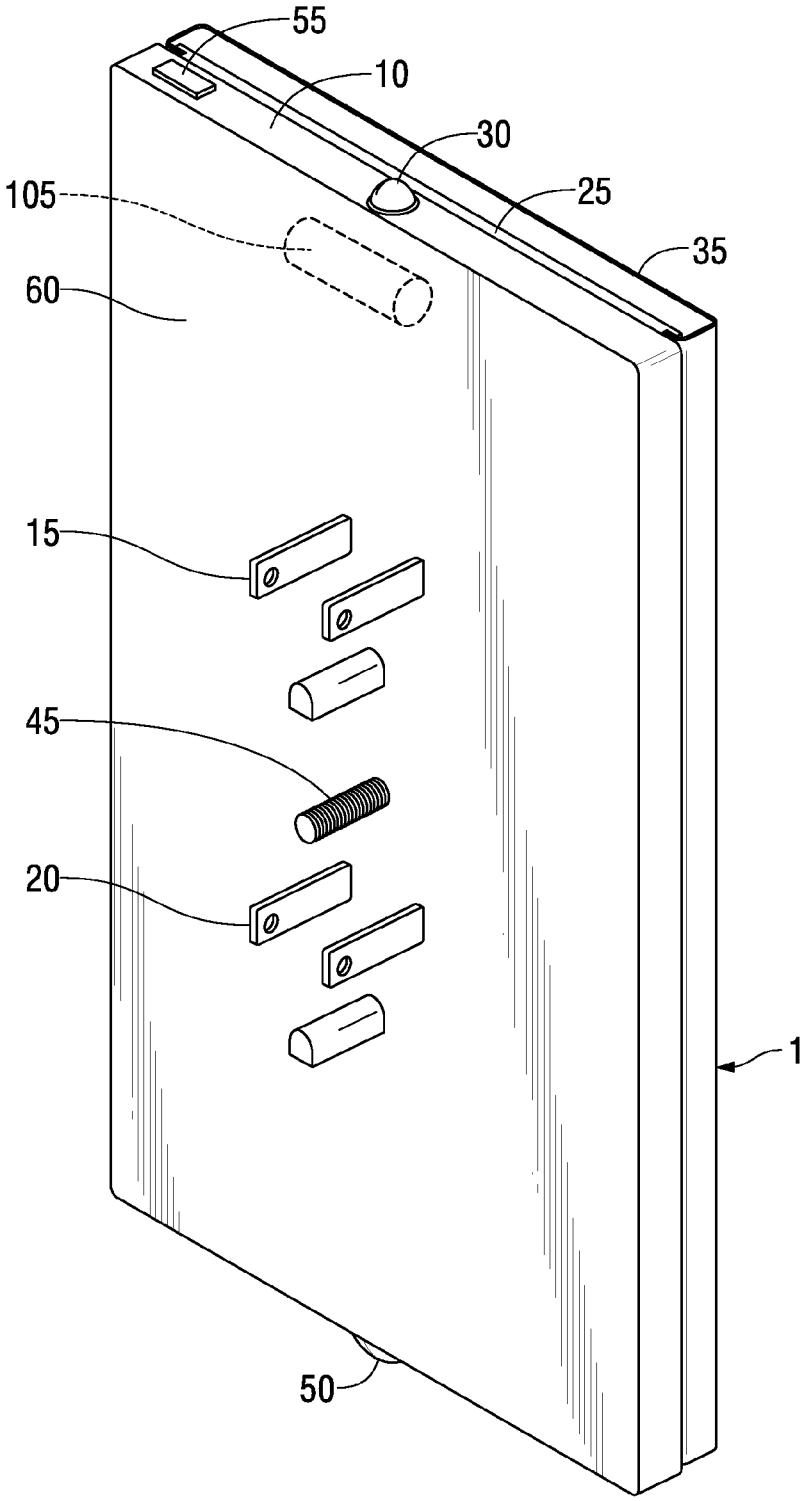
FIG. 2 illustrates one embodiment of the present invention in assembled view from the back.

As illustrated in FIG. 1, in several embodiments of the present invention the solid base 10 may be constructed with a back 60 (See FIG. 2). In several embodiments of the present invention located on the back 60 are two outlet prongs 15 and 20. In several embodiments of the present invention the two outlet prongs are constructed as used in the industry. In several embodiments of the present invention the two outlet prongs 15 and 20 are constructed as used in the industry utilizing three prong outlets, two prong outlets or other prong construction variations as known in the art. In several embodiments of the present invention the outlet prongs 15 and 20 are in electrical communication in a manner as known in the art for insertion into a common wall outlet.

As illustrated in FIG. 1, in several embodiments of the present invention the solid base 10 may be constructed with a front 65. In several embodiments of the present invention attached to the front 65 is a raised plate 25. In many embodiments raised plate 25 is constructed of plastic, resin or some other preferably non-conductive materials. Raised plate 25 can be constructed to various widths, sizes, or shapes as is known in the art. In several embodiments of the present invention the raised plate 25 can be constructed with lock extrusions 85. In several embodiments, lock extrusion 85 is capable of being a pop lock or tab lock as utilized in the industry. In several embodiments of the present invention the raised plate 25 can be premolded with the base plate 10.

Figure 3:
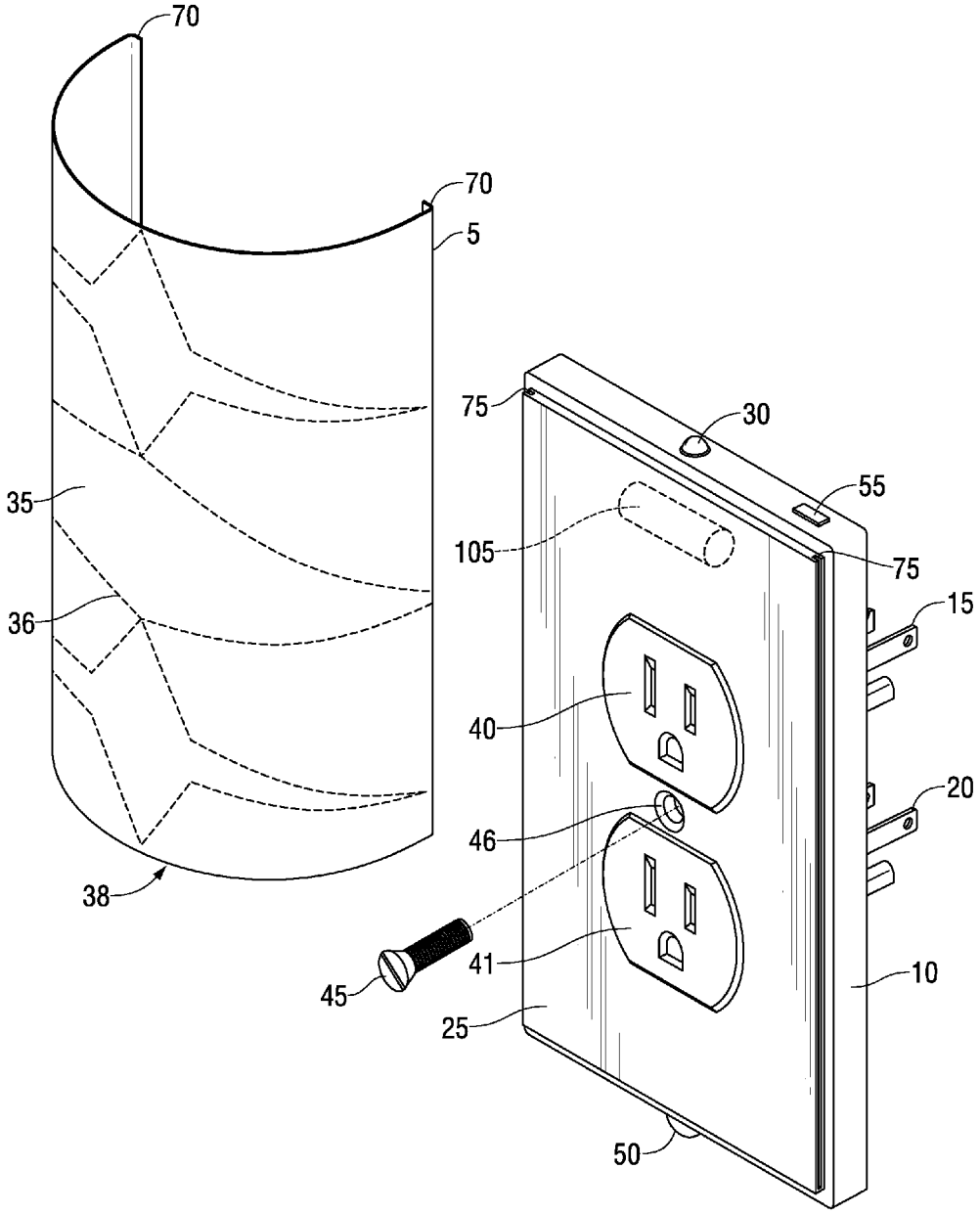
FIG. 3 illustrates one embodiment of the present invention in partially exploded view from the front.

In several embodiments of the present invention the raised plate 25 may be constructed with tracks 75 (See FIG. 3). The tracks 75 maybe constructed as those known in the industry for having insert run inside of them and allow for traverse movement between the inserts and the raised plate 25. The tracks 75 are preferably designed to allow for slidable motion between the raised plate 25 and the face plate 35. In many embodiments of the present invention, the face plate 35 slides over tracks 75 and can be temporarily locked into place by use of lock extrusions 85 in which lock extrusions 85 extend past the orifices 86 on side 5. When locked extrusions 85 click to lock face plate 35 in place. In several other embodiments of the present invention or mechanisms as known in the art can lock face plate 35 and prevent movement in relation to raised plate 25.

In several embodiments of the present invention the raised plate 25 may be constructed with outlets 40 and 41 on the face of raised plate 25. In several embodiments of the present invention the two outlet 40 and 41 are constructed as used in the industry. In several embodiments of the present invention the two outlets 40 and 41 are constructed as used in the industry utilizing three port outlets, two port outlets or other port construction variations as known in the art. In several embodiments of the present invention the outlets 40 and 41 are in electrical communication in a manner as known in the art for use in a common wall outlet.

In several embodiments of the present invention the raised plate 25 may be constructed with a screw orifice 46 (FIG. 3). Screw orifice 46 is preferable designed, as known in the art, to allow for attachment via a standard screw(s) 45 to an existing wall outlet.

As illustrated in FIG. 1, in several embodiments of the present invention there is a face plate 35. In some embodiments of the present invention the face plate may be constructed with an ornamental design on its outer face 36. In many embodiments the face plate 35 is constructed of plastic, resin or some other preferably non-conductive materials. Face plate 35 can be constructed to various widths, sizes, or shapes as is known in the art. In some embodiments of the present invention the face plate 35 maybe transparent, semi-transparent or solid. As shown in FIG. 3, face plate 35 can bubble, or extend significantly past raised plate 25 so as to allow for items to be plugged into plugs 40 while face plate 35 is in a locked position. Also illustrated is egress port 38 on face plate 35 which allows for cords of plugged in items to exit face plate 35.

As illustrated in FIG. 1, in several embodiments of the present invention the face plate 35 is constructed with sides 5 and inserts or rails 70 (FIG. 3). In some embodiments of the present invention the face plate 35 maybe constructed such that the inserts or rails 70 can mechanically engage the track 75 and allow for the face plate 35 to move parallel to the raised plate 25.

FIG. 2 illustrates one embodiment of the present invention in assembled view from the back. As illustrated in FIG. 2, screw 45 may extend all of the way though back plate 10 thereby allowing a user to attach the light emitter with outlets 1 to a standard wall outlet through mechanical communication. Also shown in FIG. 2 is a battery 105 as is included with some embodiments of the present invention. Battery 105 may be preferably located inside of hollow solid base 10 and preferably is in standard electronic communication with light emitter 50 as is known in the art for when energy is not flowing from the wall outlet itself.

Figure 4:
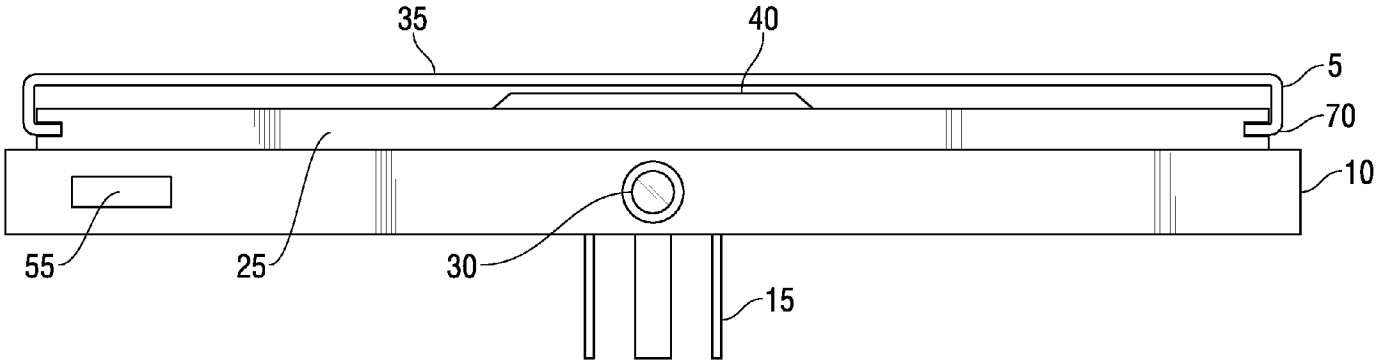
FIG. 4 illustrates one embodiment of the present invention in assembled top view.
Figure 5:
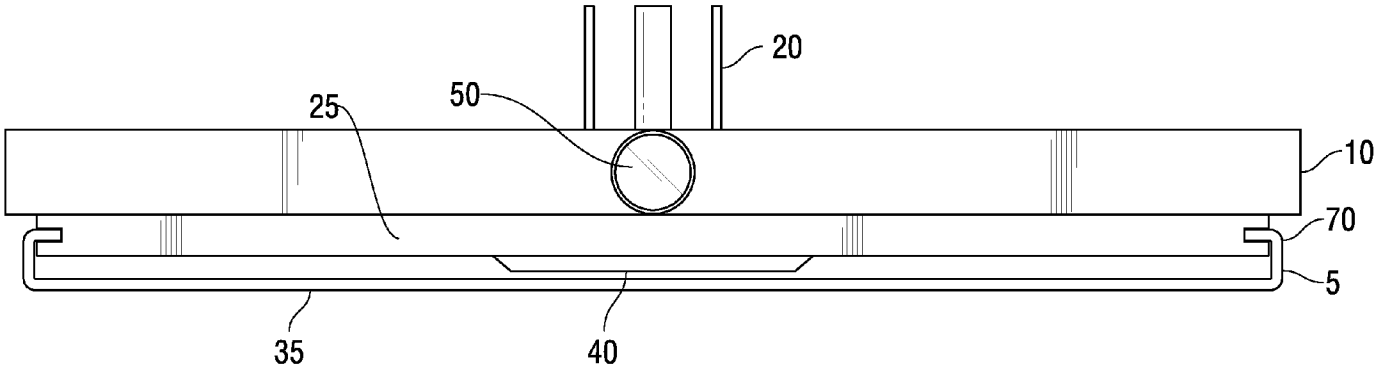
FIG. 5 illustrates one embodiment of the present invention in assembled bottom view.

FIG. 3 illustrates one embodiment of the present invention in partially exploded view from the front. As shown in FIG. 3, face plate 35 can bubble, or extend significantly past raised plate 25 so as to allow for items to be plugged into plugs 40 while face plate 35 is in a locked position. Also illustrated is egress port 38 on face plate 35 which allows for cords of plugged in items to exit face plate 35. FIG. 4 illustrates one embodiment of the present invention in assembled top view. FIG. 5 illustrates one embodiment of the present invention in assembled bottom view.

Figure 7:
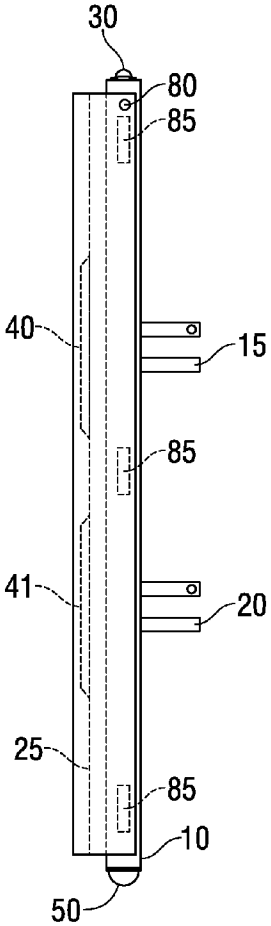
FIG. 7 illustrates one embodiment of the present invention with a flip front face in the closed position.
Figure 6:
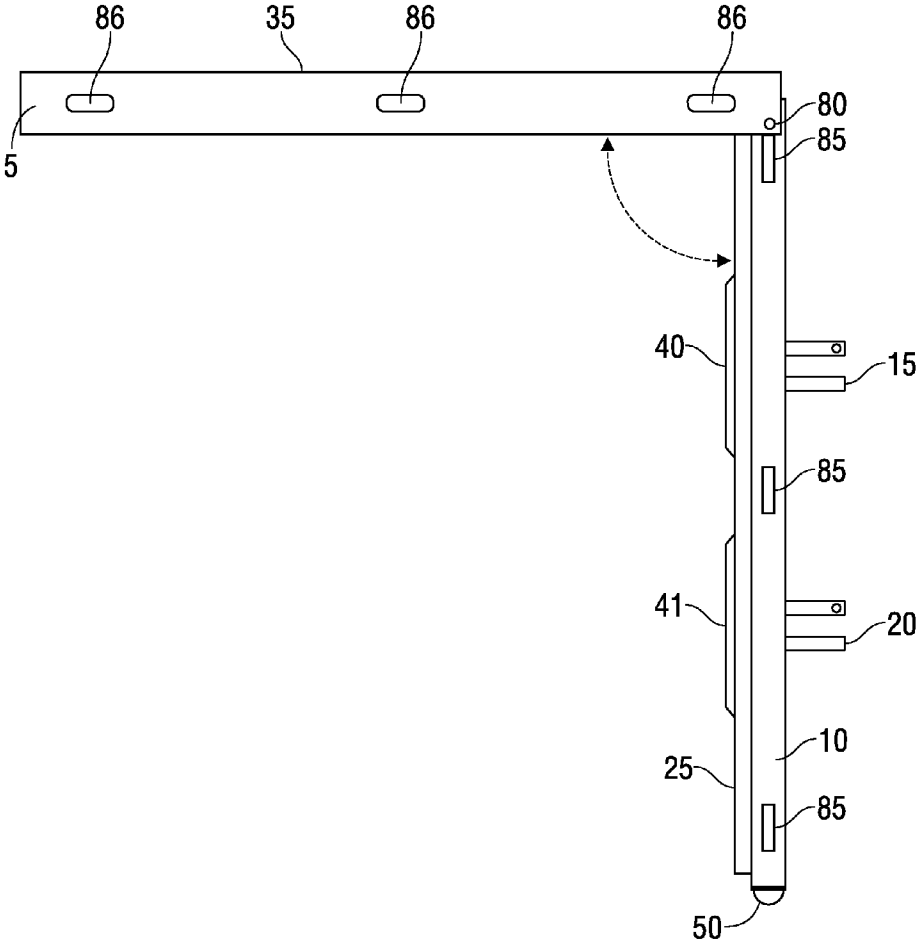
FIG. 6 illustrates one embodiment of the present invention with a flip front face in the open position.

FIG. 6 illustrates one embodiment of the present invention with a flip front face in the open position. FIG. 6 illustrates an alternative embodiment of the present invention. As illustrated, in some embodiments of the present invention, there is no track 75. In some embodiments of the invention, there are extrusion 85 which extrude from the base 10. Extrusion 85 can have the inserts 70 snap around them (FIG. 7) therein holding the cover plate 35 in place when the cover plate 35 is in a closed position (FIG. 7). See also FIG. 1. In some embodiments of the present invention, face plate 35 can attach to raised plate 25 by clicking onto extrusion 85.

As illustrated, in some embodiments, (FIG. 6-7) there is a pin/hinge 80 which attaches cover plate 35 to base 10. Pin/hinge 80 allows for cover plate 35 to rotate distal or proximate to base 35. FIG. 6 illustrated one embodiment of the present invention in which cover plate 35 is rotated away from base 10 and into an open position. FIG. 7 illustrates one embodiment of the present invention in which cover plate 35 is rotated into a closed position and inserts 70 are mechanically attached over extrusion 85 therein keeping cover plate 35 in a closed position and not allowing a user to access the plugs 40 or 41. In many embodiments of the present invention hinge 10 maybe located anywhere on base 10.

FIGS. 6 and 7 also illustrate embodiments of the invention that do not require screw 45. As shown, in several embodiments of the invention, the invention can be inserted over a wall outlet without screw 45 attaching the base 10 to the wall outlet. In these embodiments of the invention the light emitter with outlet 1 is more portable and easier to remove.

Figure 8:
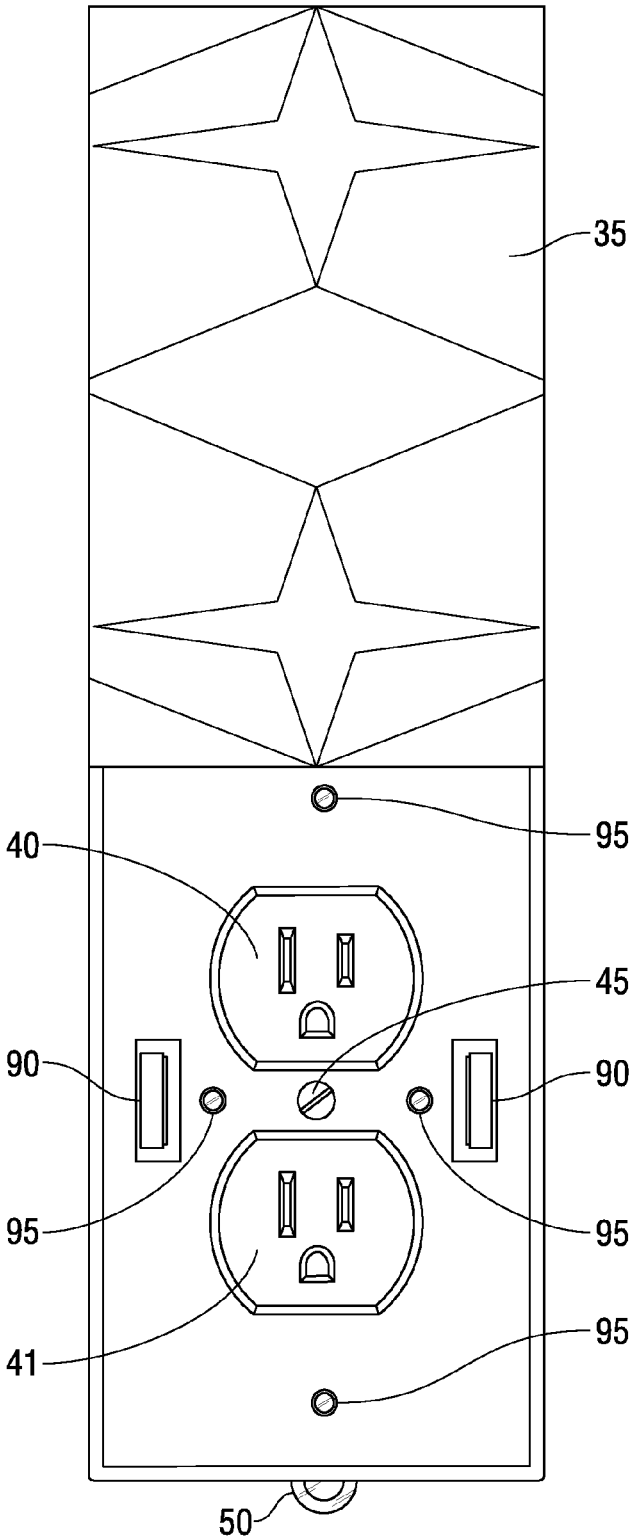
FIG. 8 illustrates one embodiment of the present invention in assembled view from the front in open position with USB ports.

FIG. 8 illustrates one embodiment of the present invention in assembled view from the front in open position with USB ports. As shown, in some embodiments of the present invention there are USB ports 90 that are installed on the raised plate 25. USB ports 90 are preferably of the type normally found in the industry.

FIG. 8 illustrates one embodiment of the present invention in assembled view from the front in open position with USB ports. As shown, in some embodiments of the present invention there are USB ports 90 that are installed on the raised plate 25. USB ports 90 are preferably of the type normally found in the industry. Also illustrated are LED 95. LED 95, in some embodiments, are designed to mechanically secure the raised plate 25 to the wall outlet as is known commonly in the art. In some embodiments of the present invention LED(s) 95 can light the face of raised plate 25 therein increasing visibility of said plate.

Figure 9:
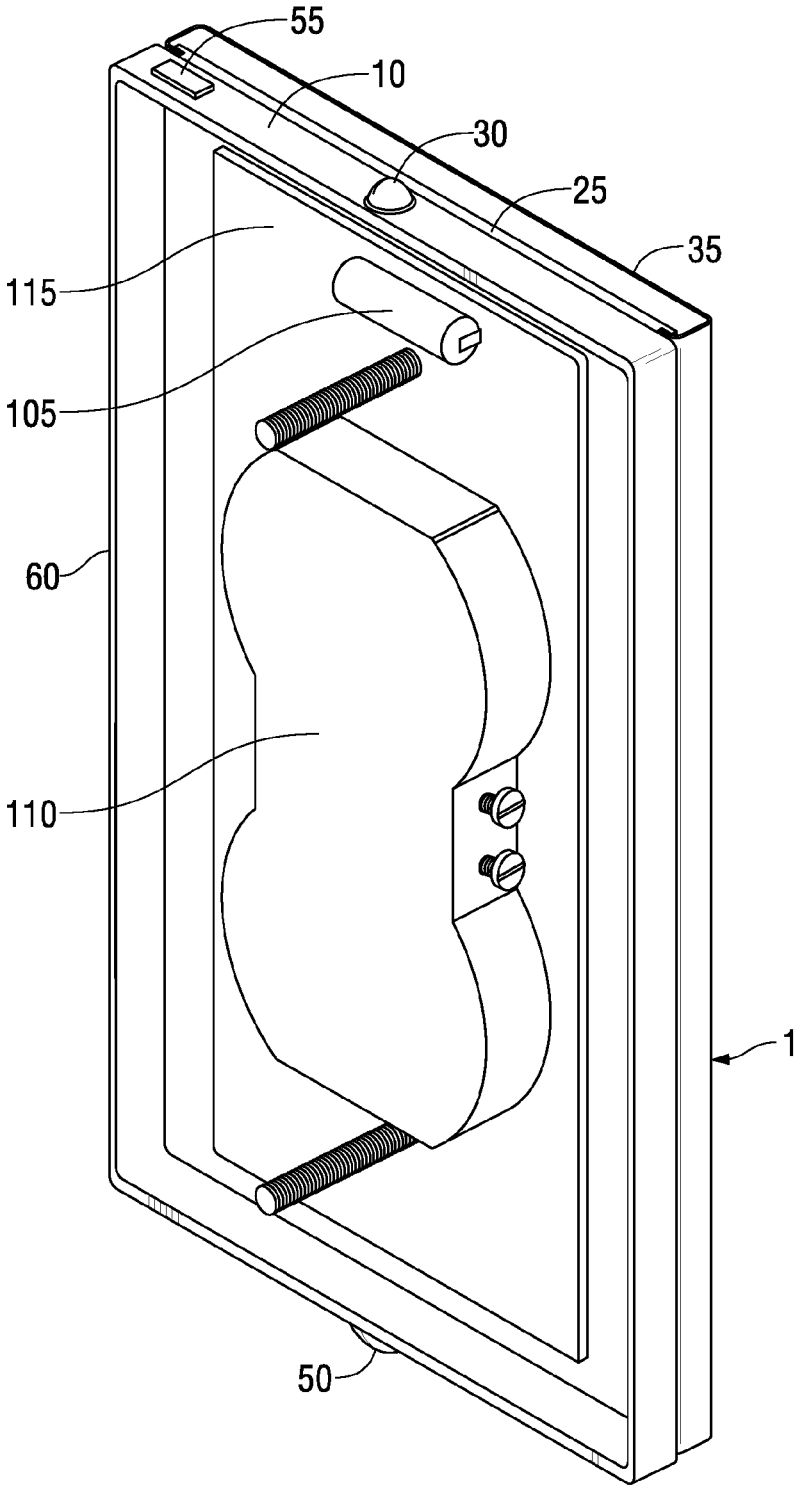
FIG. 9 illustrates one embodiment of the present invention in assembled view from the back with a full outlet face replacement.

FIG. 9 illustrates one embodiment of the present invention in assembled view from the back. As shown, in some embodiments of the present invention there are the present invention can replace an actual wall outlet face. As shown, in this embodiment, the base plate 10 is hollow with a circuit board 115 attached to standard outlet interface 110. The circuit board 115 is preferably designed as one known in the industry to facilitate electronic communication between light sensor 30 and light emitter 50 as is known in the industry to emit light in low light conditions. Also illustrated is battery 105 preferably designed to attach to circuit board 115 as known in the industry to release power if a power outage would run thought the outlet interface 110.

In some embodiments of the present invention 1 is assembled in the following manner (FIG. 3): In some embodiments of the present invention the base plate 10 is attached to a wall outlet via screw 45. The prongs 15 and 20 are inserted in to the wall outlet in a manner as known in the art. Face plate 35 is then placed on tracks 75 with inserts 70 facing into and in slidable communication with tracks 75. Face plate 35 can then slide along the tracks 75 to allow for the user to access the plugs 40 and 41. In some embodiments of the present invention 1 is assembled in the following manner: In some embodiments of the present invention the base plate 10 is attached to a wall outlet without using the screw 45.

In some embodiments of the present invention 1 is assembled in the following manner: In some embodiments of the present invention the base plate 10 is attached to a wall outlet via screw 45 or without screw 45 (FIGS. 4-7). The prongs 15 and 20 are inserted in to the wall outlet in a manner as known in the art. Face plate 35 is then attached to base plate 10 via hinge 80. Face plate 35 can then rotate about the hinge 80 and attach to base 10 covering the plugs 40 and 41 as needed via extrusions 85.

In some embodiments of the present invention 1 is assembled in the following manner: In some embodiments of the present invention the base plate 10 utilizes USB ports 90 as are known in the industry (FIG. 8).

FIG. 9 illustrates one embodiment of the present invention in assembled view from the back (a ground wire as known in the art is not illustrated in this embodiment). As shown, in some embodiments of the present invention there are the present invention can replace an actual wall outlet face. As shown, in this embodiment, the base plate 10 is hollow with a circuit board 115 attached to standard outlet interface 110. The circuit board 115 is preferably designed as one known in the industry to facilitate electronic communication between light sensor 30 and light emitter 50 as is known in the industry to emit light in low light conditions. Also illustrated is battery 105 preferably designed to attach to circuit board 115 as known in the industry to release power if a power outage would run thought the outlet interface 110. In this embodiment the base plate 10 actually replaced the original wall outlet face and interface 110 is attached to any pending wires as is known in the art of wall outlet circuitry.

In some embodiments of the present invention 1 the present invention functions as follows: The prongs 15 and 20 are inserted into a wall socket as known in the art. The plugs 40 and 41 are electrically live once the insertion occurs. If the face plate 35 is in a closed position then the plugs 40 and 41 are not accessible to a user. In order to access plugs 40 and 41 a user need only to slide the face plate 35 about the tracks 75 or to disengage the face plate 35 from the extrusion 85 and rotate the face plate 35 about the hinge 80, depending on the embodiment of the invention. A user can then plug electrical appliances into the plugs 40 and 41. See FIG. 3, 6-7.

In many embodiments of the present invention, the light emitter 50 functions by receiving signals from the sensor 30 in regards to external light conditions. Both the light emitter 50 and sensor 30 are of the kind usually found and known in the art for relaying such information to activate a light emitter in low light level conditions. In several embodiments of the present invention, there is a manual activation button 55 that a user can use to manually activate or deactivate light emitter 50 as is known in the art. See FIG. 1.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

The invention claimed is:

1. An improved light emitter with outlets comprising:

a solid base with a front, back, top and bottom;

a light emitter located on the bottom of said base;

a light sensor located on the top of said base;

a manual activation button in electrical communication with said light emitter located on the bottom of said base;

two three-port outlets located on said back of said base;

a raised plate with a face attached to said front of said base;

said raised plate further comprising lock extrusions;

said raised plate further comprising tracks;

said raised plate further comprising two three-port outlets on the face of said raised plate for communicating electronically with a wall outlet;

a face plate;

said face plate further comprising an egress port to allow for cords or plugged in items to exit said face plate;

said face plate further comprising sides with orifices, wherein said tracks allow for slidable motion between said raised plate and said face plate; and wherein said face plate can be temporarily locked into place by moving and engaging said orifices over said lock extrusions therein mechanically engaging said orifices and lock extrusions in a locking manner.

2. The outlet and light device of claim 1 further comprising;

said solid base further comprises ports for USB cable insertion;

a battery; wherein said battery powers said light emitter and said ports for USB cable insertion.

* * * * *